United States Patent [19]

Fukumoto

[11] Patent Number: 4,749,835

[45] Date of Patent: Jun. 7, 1988

[54] MECHANISM FOR CLOSING MICROWAVE OVEN DOOR

[75] Inventor: Shigeaki Fukumoto, Nara, Japan

[73] Assignee: Sharp Kabushiki Kaisha, Osaka, Japan

[21] Appl. No.: 22,097

[22] Filed: Mar. 5, 1987

[30] Foreign Application Priority Data

Mar. 20, 1986 [JP] Japan ..... 61-40927[U]

[51] Int. Cl.[4] ..... H05B 6/76

[52] U.S. Cl. ..... 219/10.55 C; 219/10.55 D; 200/50 C; 126/197

[58] Field of Search ..... 219/10.55 C, 10.55 D; 200/50 A, 50 C, 61.62, 61.64, 61.76; 126/197

[56] References Cited

U.S. PATENT DOCUMENTS 4,321,445 3/1982 Kristof et al. ..... 219/10.55 C
4,450,335 5/1984 Shimizu et al. ..... 219/10.55 D
4,497,993 2/1985 Aoyama ..... 219/10.55 C
4,504,719 3/1985 Taylor, Jr. et al. ..... 219/10.55 C
4,511,780 4/1985 Okamura ..... 219/10.55 C

FOREIGN PATENT DOCUMENTS 59-89931 5/1984 Japan ..... 219/10.55 C

*Primary Examiner*—Philip H. Leung
*Attorney, Agent, or Firm*—Flehr, Hohbach, Test, Albritton & Herbert

[57] ABSTRACT

A mechanism for engagingly closing a microwave oven door includes a latch hook and a latch head with a hook-shaped front end which engages with it when the door is closed and presses a start switch by the force of a biasing spring. When the door is opened, the latch head is slightly moved nearly perpendicularly to the direction in which the latch head is moved to become engaged with the latch hook. This perpendicular movement of the latch head causes its front end to be gradually lifted and to be disengaged from the latch hook.

7 Claims, 2 Drawing Sheets

MECHANISM FOR CLOSING MICROWAVE OVEN DOOR

BACKGROUND OF THE INVENTION

This invention relates to a mechanism for closing a microwave oven door and more particularly to a mechanism which allows a microwave oven door to be released from an engaged condition with a shorter stroke by reduced force.

A previously considered mechanism for closing a door and a microwave oven incorporating such a mechanism are respectively shown in FIGS. 4 and 5. A door 3 is provided for opening and closing an oven chamber 2 in a frontal part of the housing 1. Numeral 4 in FIG. 4 indicates a front panel of the oven chamber 2 provided with two latch hooks 5 (only one of them shown) to keep the door 3 in the closed condition. The door 3 is correspondingly provided with two elongated latch heads 7 such that they will pass through two openings 6 on the front surface of the housing 1 when the door 3 is closed. Each latch head 7 has a hook-shaped front end 9 so as to be engageable with corresponding one of the latch hooks 5. A holder 8 is provided outside of the oven chamber 2 but inside the housing 1 for mounting a switch 11 with a plunger 10 such that the hook-shaped front end 9 of the latch head 7 presses the plunger 10 to cause the output of a start signal when the door 3 is closed and the latch head 7 becomes engaged with the latch hook 5. The plunger 10 is retractably protruding and generally assumes the protruding position by biasing means (not shown).

The door 3 is released from the closed condition, that is, the engaged relationship between the latch head 7 and the latch hook 5 is terminated if an OPEN button 12 provided on an external surface of the housing 1 to operate a door releasing mechanism (not shown), thereby lifting the hook-shaped front part 9 of the latch head 7 upward. There is also another biasing spring (not shown) applying a downward biasing force on the front end 9 of the latch head 7 so that the plunger 10 will keep the switch in the ON position against the biasing force of the aforementioned biasing means on the plunger 10 when the latch head 7 is engaged with the latch hook 5.

With a mechanism described above, a fairly large force is required to press the hook-shaped front part 9 of the latch head 7 downward in order to keep the plunger 10 of the switch 11 pressed until the switch 11 is in the ON condition. Therefore, a correspondingly large force is required to lift the front part 9 of the latch head 7 to release the engagement of the latch head 7 with the latch 5. In other words, the latch 5 is heavy to operate. If the mechanism is so designed that the operation of the latch head 7 can be completed quickly by reducing the distance with which the latch head 7 must be lifted (or the so-called "stroke"), the end of the hook-shaped front part 9 of the latch head 7 comes to rub against the upper surface of the latch 5 and this tends to cause injury to the latch head 7 and the latch hook 5. On the other hand, the operation becomes troublesome to the user if the large stroke is required to release the engagement of the door.

SUMMARY OF THE INVENTION

It is therefore an object of the present invention to provide a mechanism for engagingly closing a microwave oven door with which the door can be opened with a short stroke by a reduced force.

The above and other objects are achieved by providing a mechanism embodying the present invention which, like the previously considered mechanism described above, includes one or more latch hooks disposed outside its oven chamber but inside the housing and correspondingly at least one latch head which goes through an opening on the front surface of the housing when the oven door closes the front opening of the oven chamber such that its hook-shaped front end becomes engaged with the aforementioned latch hook, thereby keeping the door in the closed condition and causing the hook-shaped front end to come into contact with a plunger of a start switch disposed outside the oven chamber inside the housing for starting the heating operation. According to the present invention, however, the latch hook is attached to the door such that it can move not only in a first direction to become engaged with the latch hook and to release such engagement but also in a second direction which is nearly perpendicular to the aforementioned first direction. For each latch head, there are attached to the surface of the door facing the oven chamber both a biasing spring which tends to cause the hook-shaped front end of the latch head to press the plunger when the latch head becomes engaged with the corresponding latch hook and a holding spring for applying a force to hold the latch head in such direction that it can become engaged with the corresponding latch hook. In addition, the mechanism of the present invention includes a protruding member which comes into contact with the front end of the latch head when the aforementioned front end is moved in the aforementioned second direction while the latch head and the corresponding latch hook are in mutually engaged relationship such that the front end of the latch head is gradually lifted in the direction of releasing the engagement of the latch head with the latch hook.

With a mechanism thus structured, the front end of the latch head presses the plunger of the start switch by the force of the biasing spring when the door is closed at the beginning of a heating operation and the hook-shaped front end of the latch head becomes engaged with its corresponding latch hook. After the end of a heating operation, if the front end of the latch head then in the engaged position is pressed and moved nearly perpendicularly to the direction of the engagement, it is gradually lifted by means of the protruding member disengaged from the latch hook, thereby releasing the pressure on the plunger and making the door openable at the same time.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DESCRIPTION OF A PREFERRED EMBODIMENT

Figure 1:
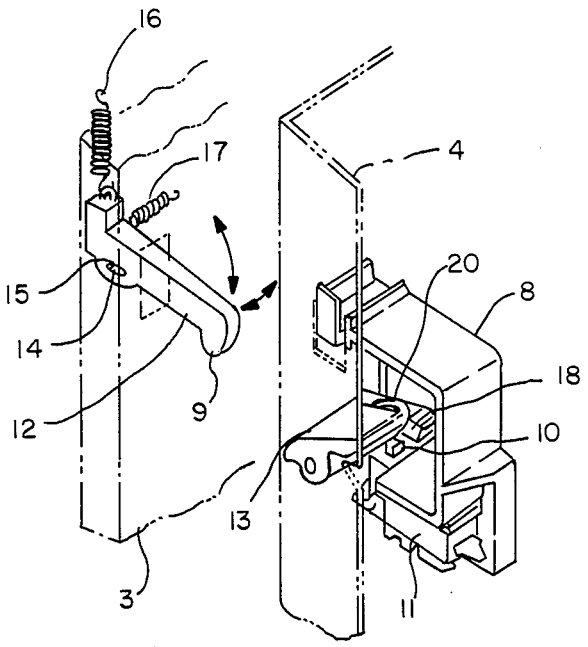
FIG. 1 is a schematic diagonal view of a mechanism embodying the present invention.
Figure 3:
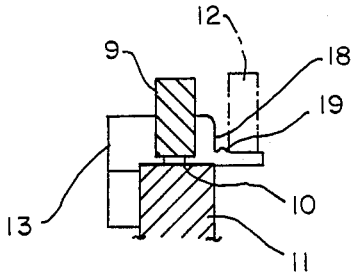
FIG. 3 is a sectional view of the latch head and the latch hook taken along the line A—A of FIG. 2.
Figure 4:
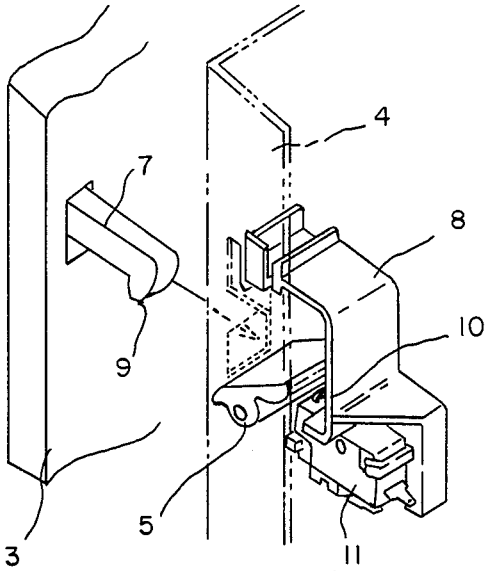
(PRIOR ART) FIG.—4
FIG. 4 is a schematic diagonal view of a previously considered mechanism of which the present invention is an improvement.
Figure 5:
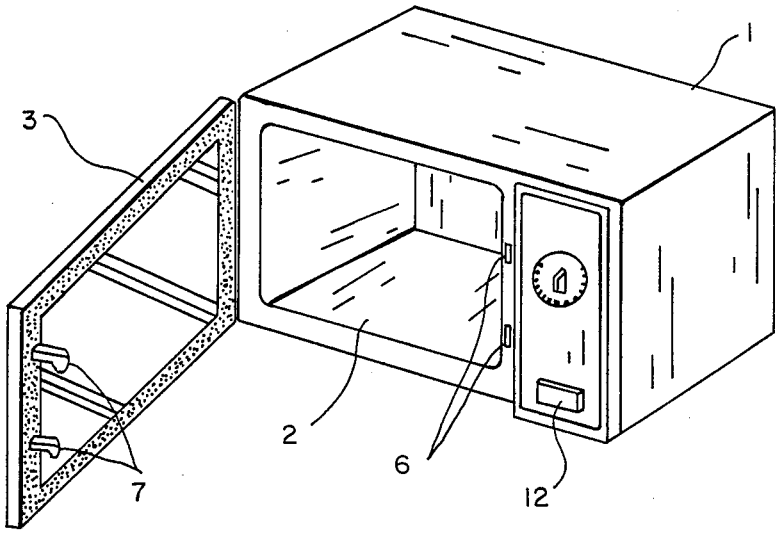
(PRIOR ART) FIG.—5
FIG. 5 is a schematic perspective view of a microwave oven with a door closing mechanism of FIG. 4.

As shown in FIG. 1 wherein components which are comparable to those shown in FIG. 4 are indicated by the same numerals, a door closing mechanism of the present invention for a microwave oven includes a latch head 12 and a latch hook 13 as its principal components. The latch hook 13 is mounted similarly as shown in FIG. 4 and the latch head 12 is of the same shape as shown in FIG. 4 with a hook-shaped front end 9. The latch head 12 is rotatably supported around an axis 14 which is provided on the surface of the door 3 facing the oven chamber 2 such that its front end 9 can move vertically. The latch head 12 has a hole 15 through which the axis 14 is passed. This hole 15 is elongated in the longitudinal direction of the latch head 12 such that its front end 9 can move back and forth in a horizontal direction. On the surface of the door 3 facing the oven chamber 2, there are also attached a biasing spring 16 and a holding spring 17. The biasing spring 16 is attached to the back end section of the latch head 12 proximal to the door 3 and serves to apply a biasing force on the latch head 12, tending to press its hook-shaped front end 9 in a downward direction. The holding spring 17 is also attached to the back end section of the latch head 12 and serves to hold the latch head 12 in such direction that it can become engaged with the latch hook 13. Numeral 8 again indicates a holder but the holder 8 according to the present invention is characterized as having a protruding member 18 which is adapted to come into contact with the hook-shaped front end 9 of the latch head 12 when the front end 9 is horizontally pressed and moved while the latch head 12 and the latch hook 13 are in mutually engaged relationship and to lift it gradually to release the engagement of the latch head 12 with the latch hook 13. The contact surface of the protruding member 18 with the front end 9 of the latch head 12 is sloped and there is a small notch 19 at the top of this slope as shown in FIG. 3 such that the latch head 12 does not move backward after it is lifted by the aforementioned protruding member. The top surface of the latch hook 13 is provided at one edge thereof with a guiding protrusion 20 which serves to guide the front end 9 of the latch head 12 towards the plunger 10 when the latch head 12 and the latch hook 13 are engaged with respect to each other such that the plunger 10 will surely be pressed by the front end 9 of the latch head 12.

Figure 2:
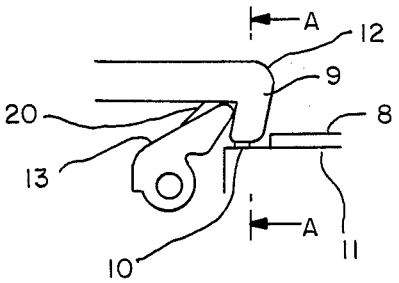
FIG. 2 is a schematic drawing showing a latch head and a latch hook of the present invention in mutually engaged relationship.

When the door 3 is closed with the engaging mechanism thus structured and the front end 9 of the latch head becomes engaged with the latch hook 13, the front end 9 of the latch head 12 presses the plunger 10 of the start switch 11 by the force of the biasing spring 16 as shown in FIG. 2, putting the start switch 11 in the ON condition. At the end of a heating operation, the hook-shaped front end 9 of the latch head 12 is pressed and moved in a horizontal direction. This causes the protruding member 18 to gradually lift the front end 9 of the latch head 12 until it becomes disengaged from the latch hook 13 and releases the pressure on the plunger 10, making the door 3 openable at the same time.

When the engagement of the latch head 12 with the latch hook 13 is released, there is no need to apply any force against the biasing spring 16 and hence the latch head 12 can be disengaged from the latch hook 13 with a much weaker force than required by a previously considered mechanism described above by way of FIG. 4. For the purpose of such a release, furthermore, the front end 9 of the latch head 12 has only to be lifted by the thickness of the latch hook 13. The operation is therefore much simplified.

The foregoing description of a preferred embodiment of the invention has been presented for purposes of illustration and description. It is not intended to be exhaustive or to limit the invention to the precise form disclosed, and obviously many modifications and variations are possible in light of the above teaching. For example, the door need not be that of a microwave oven. The mechanism need not necessarily have two latch heads 12 and two latch hooks 13 as illustrated above. The minimum requirement is that the mechanism have one latch head and one latch hook corresponding to each other. In the example illustrated in FIG. 1, the latch head 12 is moved vertically for engagement and horizontally for disengagement but the latch hook 13 may be oriented differently and the directions of engagement and disengagement may be changed accordingly. Any such modifications and variations which may be apparent to a person skilled in the art are intended to be included within the scope of this invention.

What is claimed is:

1. In a microwave oven with a housing, an oven chamber inside said housing, a door for said oven chamber, and a mechanism for engagingly closing said door, the improvement wherein said mechanism comprises a latch hook outside said oven chamber and inside said housing, a start switch with a plunger outside said oven chamber and within said housing, a latch head with a hook-shaped front end attached rotatably to said door such that said front end moves in a first direction with respect to said door to engage with said latch hook and to thereby press said plunger when said door is closed, said latch head being attached to said door in such a way that said front end can be moved in a second direction with respect to said door, said second door being substantially perpendicular to said first direction, a biasing spring attached to said latch head for pressing said front end against said plunger when said latch head engages with said latch hook, a holding spring attached to said latch head for holding said latch head to engage with said latch hook, and a protruding member disposed near said latch hook for gradually moving said front end to disengage said latch head from said latch hook if said front end is moved in said second direction when said latch head and said latch hook are mutually engaged.

2. The microwave oven of claim 1 wherein said first direction is vertical.

3. The microwave oven of claim 1 wherein said biasing spring and said holding spring are attached at one end to said door and at the other end to said latch head.

4. The microwave oven of claim 1 wherein said latch head is supported around an axis which passes through an elongated hole provided therein.

5. The microwave oven of claim 1 wherein said protruding member has a sloping surface adapted to come into contact with said latch head when said latch head is disengaged from said latch hook.

6. The microwave oven of claim 5 wherein said protruding member has a notch at the top of said sloping surface for preventing said latch head from becoming engaged with said latch hook.

7. The microwave oven of claim 1 wherein said latch hook has a guiding protrusion for guiding said front end to said plunger when said door is closed.

* * * * *